US005189344A

United States Patent [19]

Rose

[11] Patent Number: 5,189,344

[45] Date of Patent: Feb. 23, 1993

[54] SOLID STATE STROBE TUBE CONTROL CIRCUIT WITH PROGRAMMABLE FLASH PATTERN

[75] Inventor: Steven A. Rose, Kirkwood, Mo.

[73] Assignee: Public Safety Equipment, Inc., St. Louis, Mo.

[21] Appl. No.: 695,257

[22] Filed: May 3, 1991

[51] Int. Cl.[5] ..... H05B 37/02

[52] U.S. Cl. ..... 315/293; 325/241 R

[58] Field of Search ..... 315/241 R, 241 P, 241 S, 315/292, 293, 294, 291, 297, 151

[56] References Cited

U.S. PATENT DOCUMENTS

| | | | |
|---|---|---|---|
| 3,706,914 | 12/1972 | Van Buren | 315/316 |
| 3,720,929 | 3/1973 | Jones | 340/170 |
| 3,925,704 | 12/1975 | Camic | 315/241 S |
| 4,302,707 | 11/1981 | Hattori | 315/241 |
| 4,329,623 | 5/1982 | Hattori | 315/151 |
| 4,344,680 | 8/1982 | Ishida et al. | 354/33 |
| 4,345,537 | 12/1982 | Pogoda | 84/454 |
| 4,373,793 | 2/1983 | Taniguchi et al. | 354/31 |
| 4,398,127 | 8/1983 | Bahn et al. | 315/151 |
| 4,398,131 | 8/1983 | Tarroux et al. | 315/294 |
| 4,404,496 | 9/1983 | Hosoda | 315/151 |
| 4,485,336 | 11/1984 | Yoshiyama et al. | 315/241 |
| 4,613,797 | 9/1986 | Eggers et al. | 315/241 |
| 4,656,397 | 4/1987 | Chappel | 315/241 S |
| 4,684,852 | 8/1987 | Balogh | 315/241 S |
| 4,717,862 | 1/1988 | Anderson | 315/241 S |
| 4,736,907 | 4/1988 | Steffen | 315/241 S |
| 4,777,408 | 10/1988 | DeLuca | 315/158 |
| 4,798,996 | 1/1989 | Lam | 315/151 |
| 4,899,089 | 2/1990 | Hayes | 15/323 |
| 4,949,017 | 8/1990 | Sikora | 315/219 |
| 4,952,906 | 8/1990 | Buyak | 315/241 S |
| 4,954,753 | 9/1990 | Sikora | 315/219 |
| 4,956,584 | 9/1990 | Sikora | 315/241 |

*Primary Examiner*—Eugene R. Laroche
*Assistant Examiner*—A. Zarabian
*Attorney, Agent, or Firm*—Senniger, Powers, Leavitt & Roedel

[57] ABSTRACT

A solid state control circuit for storing a preset pattern and discharging a strobe tube in accordance with the preset pattern. A solid state control circuit has a programmable memory comprising a plurality of selective partitioned memory locations, each for storing a separate preset pattern, each said pattern for producing a series of timing pulses for discharging the strobe tube. For example, the patterns many include one, two or three flashes per cycle, depending on operator selection. A transformer in the "flyback" configuration and current mode control for charging the strobe tube circuitry. The current mode control uses "lossless" current sensing to limit current flows within the circuitry. The intensity of the strobe tube discharge is varied as a function of the ambient light. An anti-neoning signal disconnects power from the strobe tube after a discharge for a minimum period of time wherein the minimum period is greater than the period of time during which the connection of any electrical power to the strobe tube would result in neoning.

38 Claims, 3 Drawing Sheets

+10-28VDC
112
114
134
138
140
142
146
160
162
168
170
172
174
176
184
186
190
192
194
198
200
208
220
230
234
238
254
255
258
259
260
262
266
296
295
297
301
302
299
294
400
424
442
TO FIG. 3
116
118
120
121
318
272
330
328
324
320
316
BINARY COUNTER
PROM
270
288
434
OUTPUTS FOR INDEPENDENT CONTROL OF "SLAVE UNITS"

SOLID STATE STROBE TUBE CONTROL CIRCUIT WITH PROGRAMMABLE FLASH PATTERN

BACKGROUND OF THE INVENTION

The present invention relates to electronic control circuits for strobe tubes and, more particularly, to a solid state strobe tube control circuit which discharges a strobe tube according to a programmable flash pattern stored in memory.

Strobe tubes have been used in visual signalling devices in past applications. A limitation on their use, however, is that strobe tubes require a minimum time between flashes in order to avoid neoning and in order to store sufficient charge for the next discharge of the strobe tube. Prior strobe tube control circuits required relatively expensive timing circuits to control the time delay between discharges of a strobe tube and to provide various flash patterns. For instance, Sikora, in U.S. Pat. Nos. 4,949,017 and 4,956,584 discloses the combination of two analog oscillators for sequencing flash patterns. Accordingly, there is a need for an inexpensive solid state strobe tube control circuit having precision timing which enables the rapid discharging of a strobe tube according to various predetermined patterns.

SUMMARY OF THE INVENTION

Among the objects of the present invention may be noted the provision of a solid state strobe tube control circuit which discharges a strobe tube according to a preset pattern stored in a programmable memory; the provision of such a circuit where the programmable memory comprises a plurality of selective partitioned memory segments or locations; the provision of such a circuit which stores the preset pattern in a semiconductor device; the provision of such a circuit using a transformer in a flyback topology to charge the charge storing means for the strobe tube; the provision of such circuit where the circuit currents are limited within predetermined values; the provision of such a circuit where the primary charging current is sensed in a virtually lossless mode; the provision of such a circuit where the charging circuit is turned off once the charge storing means is fully charged; the provision of such a circuit where the intensity of the flash from a discharge of the strobe tube is a function of the ambient light; and the provision of such a circuit which provides a minimum delay after a discharge of the strobe tube wherein the minimum delay is greater than a period of time during which the connection of any electrical power to the strobe tube would result in current flowing through the strobe tube, whereby neoning of the strobe tube is prevented.

Generally, in one form the invention provides a control circuit for discharging a strobe tube. The control circuit comprises means for supplying power to the strobe tube and means, including a semiconductor memory, for storing a preset pattern. The control circuit further comprises means responsive to the pattern storing means for triggering the strobe tube, whereby the strobe tube flashes in accordance with the preset pattern. The control circuit may include a semiconductor memory comprising a plurality of partitioned memory segments, each for storing a separate preset pattern. The control circuit may also include a power supply means comprising a charging system including a transformer. The control circuit may also include a switching means comprising a transistor connected in series with a primary side of the transformer. The control circuit may further include a power supply means further comprising means for limiting a primary current flowing through the primary side of the transformer. The control circuit may further include means for disconnecting the power supply means from the strobe tube for a minimum period of time after the strobe tube is discharged, whereby neoning of the strobe tube is prevented. The control circuit may also include a power supply means further comprising means responsive to ambient light for producing an ambient light signal representative of a level of the ambient light.

In another form of the invention, an anti-neoning control circuit for a strobe tube is repeatedly charged and discharged by a power supply comprising means for producing an anti-neoning pulse indicating a discharge of the strobe tube; means responsive to the anti-neoning pulse for disconnecting the strobe tube from the power supply for a minimum period after the discharge, wherein the minimum period is greater than a period of time after the discharge during which the connection of the power supply to the strobe tube would result in current flowing through the strobe tube, whereby neoning of the strobe tube is prevented. The anti-neoning control circuit may include a PROM.

In still another form of the invention, a flashing device for providing repeated high-intensity flashes comprises a strobe tube; means for supplying power to the strobe tube; means, including a semiconductor memory, for storing a preset pattern; and means responsive to the storing means for triggering the strobe tube in accordance with the preset pattern.

In yet another form, the invention comprises a control circuit for discharging a strobe tube in accordance with operator input. Means supplies power to the strobe tube. Means responsive to the operator input indicates a flash pattern including either one flash per cycle or a plurality of flashes per cycle. Means responsive to the pattern indicating means triggers the strobe tube in accordance with the indicated flash pattern as specified by the input.

Other objects and features will be in part apparent and in part pointed out hereinafter.

DETAILED DESCRIPTION OF THE PREFERRED EMBODIMENTS

Figure 1:
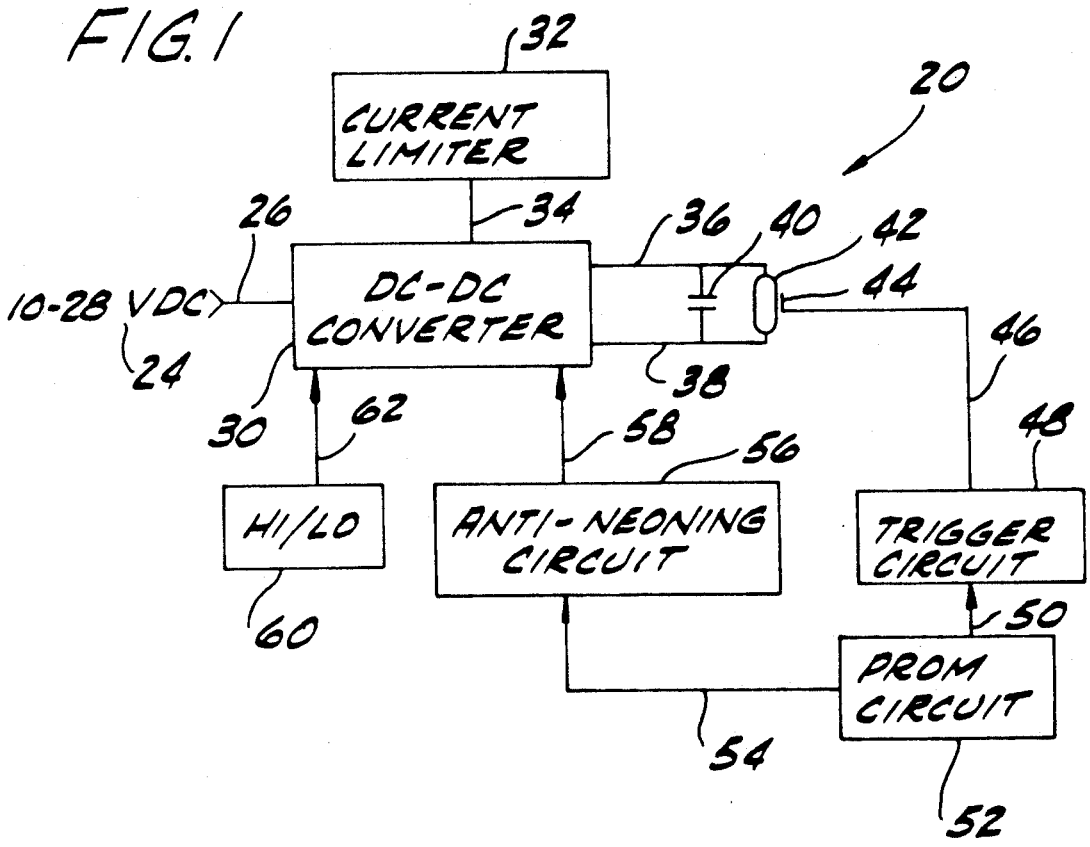
FIG. 1 is a block diagram of an electronic circuit according to the present invention.

Referring now to FIG. 1, a block diagram for a control circuit 20 for discharging a strobe tube is illustrated. The circuit 20 includes a 10–28 volt source of dc power 24 connected by line 26 to a dc/dc converter 30. A current limiter 32 is connected via line 34 to dc/dc converter 30 to limit the input to dc/dc converter 30. The output of dc/dc converter 30 is connected via lines 36 and 38 across a charge storing means 40, such as a capacitor, connected in parallel with a strobe tube 42, which will be selectively flashed. A trigger 44 is positioned adjacent to strobe tube 42 for triggering a discharge of the tube causing it to flash. Trigger 44 is connected via line 46 to a trigger circuit 48, which energizes the trigger 44 for effecting a discharge. Trigger circuit 48 is connected via line 50 to a PROM circuit 52. PROM circuit 52 predetermines the timing pattern of the discharges of strobe tube 42.

PROM circuit 52 is also connected via line 54 to an anti-neoning circuit 56. Anti-neoning circuit 56 is connected via line 58 to dc/dc converter 30. Anti-neoning circuit 56 disables dc/dc converter 30 from charge storing means 40 and strobe tube 42 for at least a minimum period after each discharge. The minimum period is greater than a period of time needed after the discharge to permit the gas in the strobe tube to deionize thereby preventing current flowing through strobe tube 42. Current flow during the minimum period is undesirable because it causes the strobe tube 42 to glow thereby preventing recharging of charge storing means 40.

Hi/Lo circuit 60 is connected via line 62 to dc/dc converter 30. Hi/Lo circuit 60 is responsive to ambient light and it determines the amount of charge stored in charge storing means 40 as a function of the ambient light. The amount of charge determines the intensity of light from the discharge of strobe tube 42 so that the intensity is controlled as a function of the ambient light.

Figure 2:
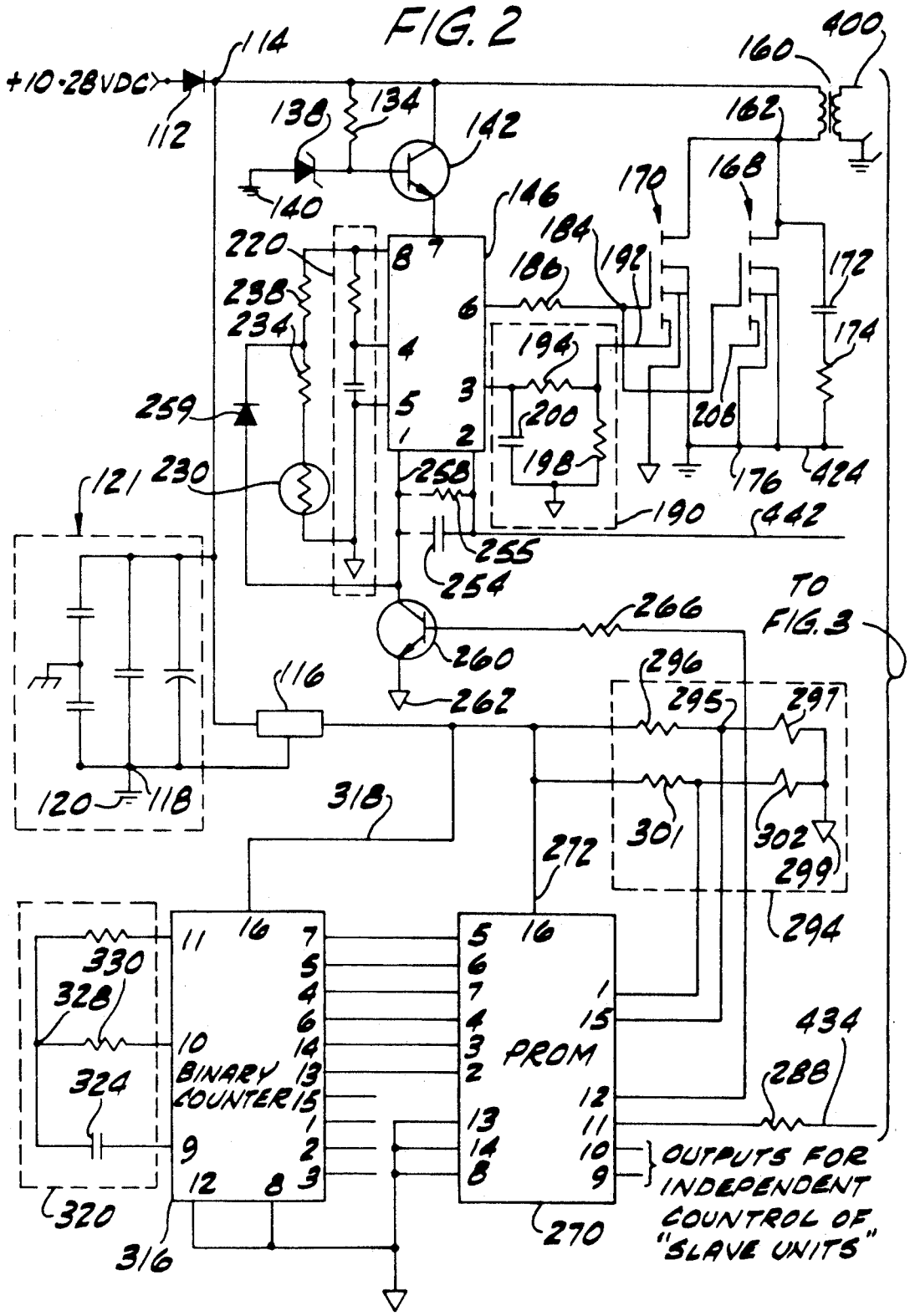
FIGS. 2 and 3 are a schematic diagram of an electronic circuit according to the present invention.
Figure 3:
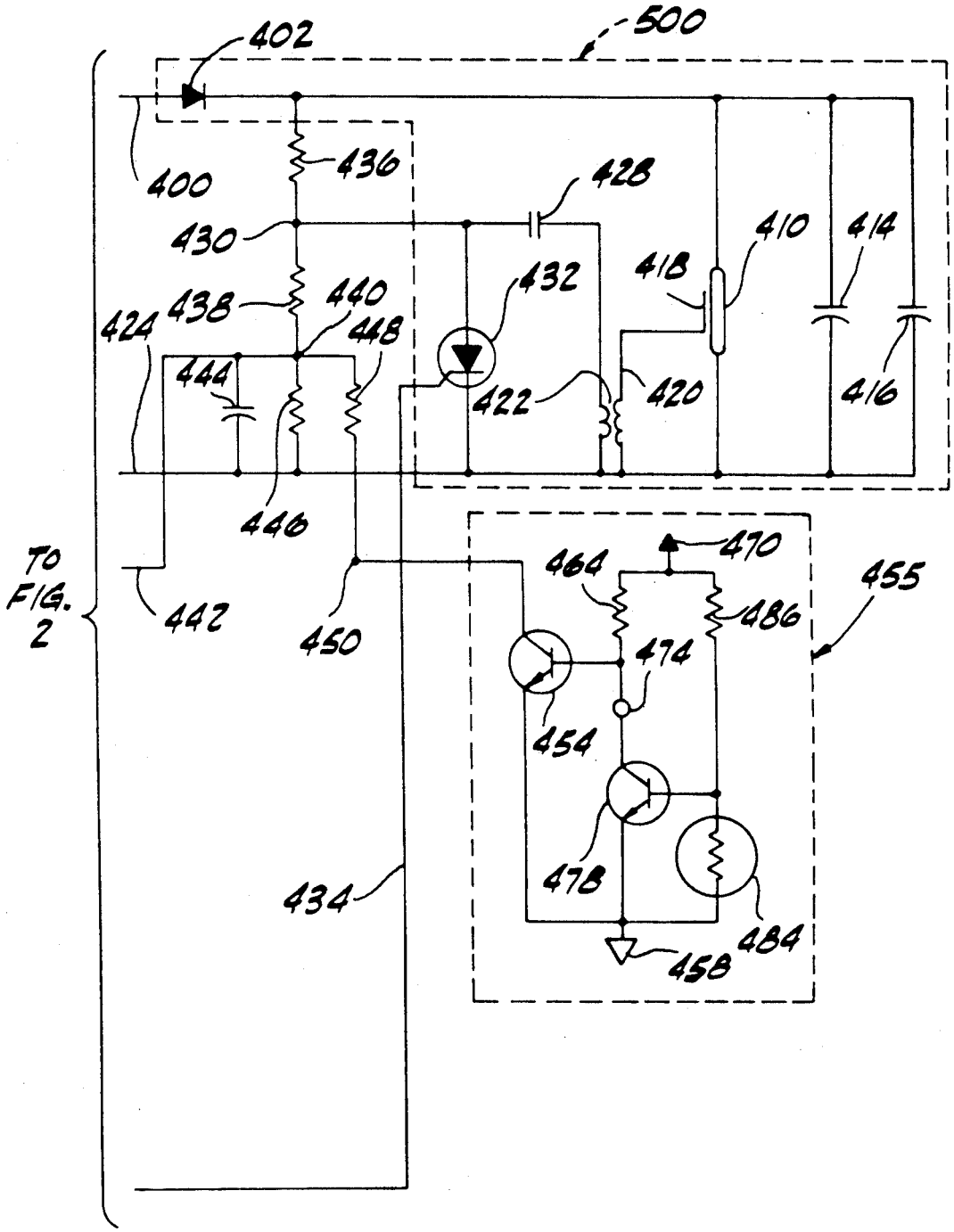

FIGS. 2 and 3 illustrate one preferred embodiment of the block diagram in FIG. 1. Referring first to FIG. 2, the circuit shown includes power input terminal 110 which is preferably connected to a 10–28 volt dc power source. Power terminal 110 is connected to the anode of Schottky diode 112. The cathode of diode 112 is connected to junction 114. Junction 114 is connected to the input of voltage regulator 116. Voltage regulator 116 is connected to junction 118 which is grounded at ground 120. Filtering network 121 is connected across the input of voltage regulator 116 to remove any ac currents from the 10–28 volt dc power supply. Filtering network 121 includes an array of capacitors which are connected in parallel between junctions 114 and 118. Filtering network 121 also filters noise generated by the strobe unit to keep it off of the power supply lines.

Junction 114 is connected through resistor 134 to the cathode of zener diode 138. The anode of zener diode 138 is connected to ground 140. Junction 114 is also connected to the collector of transistor of 142. The base of transistor 142 is connected to the cathode of zener diode 138. The emitter of transistor 142 is connected to power supply pin 7 of IC chip 146. Resistor 134, zener diode 138 and transistor 142 form a voltage regulator which limits the maximum voltage at the emitter of transistor 142 to 16 volts. The regulator circuit passes any voltages below the regulation point of 16 volts. Any input voltage greater than 16 volts is regulated. The IC chip 146 internally shuts down when the input voltage to pin 7 falls below a present value. IC chip 146 is preferably UC 3843AN.

Junction 114 is also connected to the primary side of transformer 160. The other tap of the primary side of transformer 160 is connected to junction 162. Junction 162 is connected to the drains on MOSFET transistors 168 and 170. The sources on MOSFET transistors 168 and 170 are connected to grounded junction 176. Capacitor 172 and resistor 174 are connected in series between junctions 162 and 176. The gates on MOSFET transistors 168 and 170 are connected at junction 184. Junction 184 is connected via resistor 186 to the output pin on IC chip 146. When IC chip 146 applies a voltage on the output pin, it renders MOSFET transistors 168 and 170 conductive and allows current to flow through the primary side of transformer 160, thereby inducing a magnetic field within the primary side.

Circuit 190 is a voltage divider filter/network which converts the signal obtained from the mirror terminal 192 of MOSFET transistor 170 into a signal usable by IC chip 146. Circuit 190 includes grounded current sense resistor 198 and resistor 194 and capacitor 200 comprising a low-pass filter network. Mirror terminal 208 on MOSFET transistor 168 is not used in the circuit.

The duty cycle and frequency of IC chip 146 are determined by the elements in phantom block 220. Phantom block 220 includes a resistor and a capacitor for setting the rc time constant which controls the frequency. Thermistor 230 and diode 259 compensate for variations in temperature. Resistors 234 and 238 along with diode 259 and thermistor 230 allow the maximum current through the primary circuit to be set to some predetermined value.

Pin 2, the non-inverting feedback input of IC chip 146, is connected to line 442. Capacitor 254 and resistor 255 are connected in parallel between pins 1 and 2 and determine the frequency response of the feedback circuit. Pin 1, the operational amplifier output of IC chip 146, and the anode of diode 259, are connected to the collector of transistor 260. The emitter of transistor 260 is connected to ground 262. The base of transistor 260 is connected via resistor 266 to pin 12 on PROM 270. Operation of transistor 260 is described below. Line 272 is connected to the power input pin 16 on PROM 270. Line 272 is connected to the five volt output of voltage regulator 116. Enable pins 13 and 14 and input pin 8 of PROM 270 are grounded. Pins 9 and 10 of PROM chip 270 are not connected in this circuit, but could be used to drive slave units 500 as described more fully below. When PROM 270 outputs a voltage at pin 11, the strobe tube is triggered. Pin 11 is connected via resistor 288 to line 434 (see FIG. 3).

Circuit 294 is used to select one of four memory segments or locations in PROM 270 for predetermining the flash pattern of the strobe tube. Circuit 294 includes junction 295 which is connected to memory address pin 15 of PROM 270. Junction 295 is also connected via resistor 296 to the five volt source. Junction 295 is also connected via jumper 297 to ground 299. Memory address pin 1 of PROM 270 is connected via resistor 301 to pin 16. Resistor 301 is connected via jumper 302 to ground 299. One skilled in the art will recognize that PROM 270 may constitute a Read Only Memory, Erasable Programmable Read Only Memory, Random Access Memory, Programmable Logic Array, Programmable Logic Device, transistor bank or the like.

In operation, PROM 270 will signal a double flash pattern for the strobe tube. If, however, jumper 297 is removed, pin 15 will transition from ground voltage up to 5 volts. Thus, a logic level change from 0 to 1 will be received as a memory address at pin 15 of PROM 270. This will cause PROM 270 to output from a second memory segment or location and will signal a triple flash pattern for the strobe tube. Similarly, if jumper 302 is removed, a logic level change from 0 to 1 will be received at memory address pin 1 of PROM 270. This will cause PROM 270 to output from a third memory segment or location and will signal a single flash pattern for the strobe tube. Finally, if both jumpers 297 and 302 are removed, PROM 270 will output from a fourth memory segment or location which will restore the signal to a double flash pattern for the strobe tube. The jumpers in combination with the memory address pins of the PROM constitute means responsive to operator input for indicating a single or multiple flash pattern per cycle and enable the user to change the flash pattern in the field.

Pins 2, 3, 4, 7, 6, and 5 of PROM 270 are respectively connected to output pins 13, 14, 6, 4, 5 and 7 of CMOS binary counter 316. Output pins 1, 2, 3 and 15 of counter 316 are not used. Power input pin 16 of counter 316 is connected via line 318 to the five volt source. Ground pin 8 and reset pin 12 of counter 316 are both grounded. Circuit 320 controls an internal oscillator of counter 316 and is used to set the frequency at which counter 316 counts. Circuit 320 includes capacitor 324 which is connected to pin 9 of counter 316. Capacitor 324 is also connected to junction 328. Resistor 330 is connected to pin 10 of counter 316. Resistor 330 is also connected to junction 328. Resistor 334 is connected to pin 11 of counter 316. Resistor 336 is connected to junction 328.

FIG. 3 shows the remaining portion of the strobe tube control circuit. Line 400 is connected to the secondary side of transformer 160 shown in FIG. 2. Line 400 is connected to the anode of diode 402. The cathode of diode 402 is connected to strobe tube 410. Strobe tube 410 is connected in parallel with capacitors 414 and 416. Trigger 418 is positioned adjacent to strobe tube 410 for triggering a discharge of said strobe tube. Trigger 418 is connected to the secondary side of transformer 422. The other tap on the secondary side of transformer 422 is connected to line 424. The primary side of transformer 422 is also connected to line 424. Line 424 is connected to junction 176 shown in FIG. 2. The other tap on the primary side of transformer 422 is connected through capacitor 428 to the anode of silicon controlled rectifier element 432. The cathode of silicon controlled rectifier element 432 is connected to line 424. The control input of silicon controlled rectifier element 432 is connected via line 434 to resistor 288 shown in FIG. 2.

Resistor 436 is connected between the cathode of diode 402 and the anode of silicon controlled rectifier element 432. Resistor 438 is connected between resistor 436 and junction 440. Junction 440 is connected via line 442 to capacitor 254 shown in FIG. 2. Capacitor 444 and resistor 446 are connected in parallel between line 424 and junction 440. Resistor 448 is connected between junctions 440 and 450.

Junction 450 is connected to the collector of transistor 454 in hi/lo circuit 455. The emitter of transistor 454 is connected to ground 458. The base of transistor 454 is connected through resistor 464 to power source 470. The base of transistor 454 is also connected through drillout point 474 to the collector of transistor 478. The emitter of transistor 478 is connected to ground 458. The base of transistor 478 is connected through light sensing element 484 to ground 458. Resistor 486 is connected between power source 470 and the base of transistor 478.

In operation, transformer 160 is used in what is commonly known as a "flyback" topology. A current is allowed to flow through the primary side when the parallel MOSFET transistors 168 and 170 are switched on. IC chip 146 controls the switching by applying a voltage to the gates of the MOSFETs. This current increases linearly from some initial value to some maximum value, as preset by the control IC chip 146. As current flows through the primary circuit, a voltage is induced in the secondary circuit. The polarity of the induced voltage is such that diode 402 is reverse biased and current cannot flow through diode 402. Because current cannot flow in the secondary circuit, energy is stored in the magnetic field of the transformer. Once the current flowing through the primary has reached its maximum value, or the maximum duty cycle has been reached, the MOSFETs are switched off. This causes the voltage across the primary to reverse polarity or "flyback." In turn, the large voltage induced in the secondary reverses polarity, forward biasing diode 402 and allowing the energy stored in the magnetic field to be transferred to capacitors 414 and 416 of the secondary side. By repeatedly transferring energy by this method, charge is stored in capacitors 414 and 416 until they reach a voltage of approximately 420 volts dc. It is seen that the circuit may also be implemented by using alternating current to power a transformer in the flyback topology.

IC chip 146 controls the switching function. The frequency and duty cycle are set by the rc time constant of the components within phantom block 220. The frequency is preferably set at 50 KHz and the duty cycle at 50%.

To limit the current flows during any one charging cycle, IC chip 146 senses the primary current flowing through MOSFET transistors 168 and 170 using circuit 190 and switches them off when the current reaches a predetermined maximum. This circuit operation yields two benefits. First, it ensures that the same amount of energy is delivered to the main charge storing capacitors 414 and 416 (which are described in more detail below) during each incremental charging cycle. By knowing the number of incremental charge cycles per second, therefore, the charge level in the main charge storing capacitors 414 and 416 can be determined and controlled as a function of time. Second, the current limiting prevents the primary current from exceeding safe limits. Further, if the strobe tube were ever short circuited, the current limiting would cause the circuit to limit the primary current and would again protect the circuit elements.

The current sensing and limiting is accomplished through the mirror terminal 192 on MOSFET transistor 170. Because MOSFET transistor 170 is in parallel with MOSFET transistor 168, the sensed current is approximately one half of the current flowing through the primary side of transformer 160 and is treated accordingly. The mirror terminal 192 conducts less than 1% of the primary current. MOSFET 168 is optional and may be included if primary currents are too large to be handled by a single transistor. To sense the current, the mirror terminal current is directed through circuit 190. The voltage thereby produced at pin 3 of IC chip 146 is directly proportional to the primary current. When this voltage exceeds a predetermined limit, IC chip 146 sets the voltage at pin 6 to zero, thus rendering MOSFET transistors 168 and 170 nonconductive which stops further primary current flow. Since the mirror terminal 192 conducts less than 1% of the primary current, this current limiting is virtually lossless. After the stored magnetic energy has been transferred to the secondary circuit and the remainder of the switching cycle completed, the next charging cycle is initiated.

A second form of over-current protection is provided to turn off the charging circuit once the main capacitors 414 and 416 have been charged to their predetermined full charge level. The full charge level is determined as a function of the voltage appearing at junction 440. The junction 440 voltage is applied over feedback line 442 to pin 2 of IC chip 146. When this voltage exceeds a maximum level, indicating that the main charge storing capacitors 414 and 416 have reached the predetermined full charge level, the switching output pin 6 of IC chip 146 is turned off rendering MOSFET transistors 168 and 170 nonconductive. This in turn prevents further charging of capacitors 414 and 416, which could lead to excessive voltages, thereby preventing possible damage to other circuit elements.

The voltage at junction 440 is determined by: (i) the voltage level on the main charge storing capacitors 414 and 416: (ii) the values of the voltage divider resistors 436, 438, 446 and 448 connected in parallel with capacitors 414 and 416; and (iii) the resistance condition at junction 450 set by Hi/Lo circuit 455. When there is a high level of ambient light, junction 450 is effectively grounded by Hi/Lo circuit 455. In this condition, resistors 446 and 448 are effectively connected in parallel between junction 440 and ground. The voltage divider circuit now appears as the series resistance of resistors 436 and 438 in series with the combined parallel resistance of resistors 446 and 448 between junction 440 and ground. As capacitors 414 and 416 are charged, their voltage rises causing a corresponding increase in the voltage level of junction 440 as determined by the voltage divider resistors. When the voltage at junction 440 reaches the maximum allowable level, the capacitors 414 and 416 will be fully charged and the charging circuit will be switched off as explained above.

When there is a low level of ambient light, however, Hi/Lo circuit 455 appears as an infinite resistance which effectively removes resistor 448 from the voltage divider circuit. The voltage divider circuit now appears as only the series resistance of resistors 436, 438 and 446. This causes an increase in the resistance between junction 440 and ground so that a greater percentage of the voltage is divided over resistor 446. Consequently, the voltage at junction 440 for low ambient light conditions as compared to high ambient light conditions is greater for a given charge condition in main capacitors 414 and 416. Thus, junction 440 will reach the maximum allowed voltage quicker during low ambient light conditions and will turn off the charging circuit at a lower charge level on capacitors 414 and 416. This achieves one object of the invention, to have a lower full charge level and therefore a lower strobe output during low ambient light conditions.

The above operation of Hi/Lo circuit 455 is accomplished through light sensing element 484. When there is a high level of ambient light, element 484 is effectively a short circuit which turns off transistor 478 and turns on transistor 454. This effectively shorts junction 450 to ground 458 through transistor 454. When there is a low level of ambient light, element 484 is effectively an open circuit which turns on transistor 478 and turns off transistor 454. This effectively connects junction 450 through line 452 to the nearly infinite resistance of the collector of turned off transistor 454.

Once capacitors 414 and 416 are fully charged as determined by the voltage level at junction 440 (approximately 420 volts dc on the capacitors when there is a high level of ambient light), the circuit is ready to discharge the strobe tube. At this point, silicon controlled rectifier element 432 is nonconductive. Further, resistors 436 and 438 (resistor 446 being of negligible value) divide the 420 volts dc so that approximately 250 volts dc appears at junction 430. The voltage at junction 430 is stored across capacitor 428.

PROM 270 may now signal for a discharge by applying a voltage to line 434. This voltage causes silicon controlled rectifier element 432 to become conductive, discharging capacitor 428 and creating a current pulse in the primary side of transformer 422. This current pulse induces a voltage in the primary which is transformed by transformer 422 and induces a voltage of approximately 10–15 kilovolts in the secondary side. This secondary voltage is applied to the trigger 418 which renders strobe tube 410 conductive. The charge stored in capacitors 414 and 416 is now discharged through strobe tube 410 causing a visible flash.

There is a minimum period which must expire before capacitors 414 and 416 can be charged again in anticipation of the next discharge. If these capacitors are charged immediately after discharge of strobe tube 410, a current will flow through the strobe tube causing the phenomena commonly known as neoning. PROM 270 ensures that neoning will not occur between discharges. The output of PROM 270 at pin 12 is the anti-neoning signal. It is applied to the base of transistor 260, rendering the transistor conductive. This effectively grounds pin 1 of IC chip 146, thereby causing IC chip 146 to set the voltage at pin 6 to zero and rendering MOSFETs 168 and 170 nonconductive. After the anti-neoning signal from PROM 270 is set to zero volts, transistor 260 becomes nonconductive and the switching operation in IC chip 146 is again enabled for the next charging cycle.

The output of PROM 270 at Pin 12 can also be used to vary the intensity of the individual flashes within a flash pattern. As seen above, the amount of charge stored in capacitors 414 and 416 is directly related to the amount of time during which the charging system is enabled for a particular charging cycle. In a double flash pattern, for instance, it may be desirable to have the second flash consume only one half of the energy of a first full intensity flash. Accordingly, PROM 270 would be programmed to output a voltage at Pin 12 after only one half of the time required to fully charge capacitors 414 and 416, thereby stopping the charging process at this time. No further charging would occur prior to the next discharge of the strobe tube. Other energy level distributions can be easily obtained between the flashes in a particular flash pattern by applying these principles. It will be noted that the lesser time required to charge only partially the capacitors 414 and 416 provides the user with greater flexibility in setting the timing sequence for a particular flash pattern.

The addresses in PROM 270 are read out using binary counter 316 in a common configuration. The rc time constant of the elements in circuit 320 sets the frequency of the oscillator in the counter and thereby determines the interval between successive outputs from the PROM.

In order to produce a multiple flash pattern, the timing for the charging of capacitors 414 and 416, and the timing for the anti-neoning pulses between the strobe tube discharges are all stored in the PROM. The binary contents of the PROM for selective single, double and triple flash patterns with default to a double flash pattern are preferably those contained in Appendix A hereto. Furthermore, it should be noted that the use of the PROM in the circuit advantageously enables the user to reprogram the PROM in the field without hardware changes to adapt the circuit to particular applications.

Finally, it will be seen that the elements within phantom block 500 could comprise one of a series of "slave units," all of which are powered and controlled by a single set of the remaining elements in FIGS. 2 and 3. The slave units would be connected in parallel with respect to their charging requirements. The control for triggering the different strobe tubes, however, could be independently accomplished by connecting line 434 of each slave unit to a different output pin on PROM 270. Pins 9 and 10 on PROM 270 are shown for this purpose, and more outputs could be made available as circumstances required.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

The following is a listing of the Series 900 Strobe PROM. The default operation is a double flash mode. If jumper 302 corresponding to A6 is cut, the flash mode becomes a single flash. If jumper 297 corresponding to A7 is cut, the flash mode becomes triple flash. If both jumpers are cut, the flash mode again becomes a double flash. This allows the user to change back to the default mode without the need to service the unit at the factory.

Memory Partition Designations

| Address | Flash Mode |
|---|---|
| 00 - 3F | Default Double Flash |
| 40 - 7F | Single Flash |
| 80 - BF | Triple Flash |
| C0 - FF | Double Flash |

| ADDRESS | | | | | | | | OUTPUT | | | | |
|---|---|---|---|---|---|---|---|---|---|---|---|---|
| A7 | A6 | A5 | A4 | A3 | A2 | A1 | A0 | Q3 | Q2 | Q1 | Q0 | |
| 0 | 0 | 0 | 0 | 0 | 0 | 0 | 0 | 0 | 0 | 0 | 1 | Double Flash |
| 0 | 0 | 0 | 0 | 0 | 0 | 0 | 1 | 0 | 0 | 0 | 1 | (default) |
| 0 | 0 | 0 | 0 | 0 | 0 | 1 | 0 | 0 | 0 | 0 | 1 | |
| 0 | 0 | 0 | 0 | 0 | 0 | 1 | 1 | 0 | 0 | 0 | 1 | |
| 0 | 0 | 0 | 0 | 0 | 1 | 0 | 0 | 0 | 0 | 0 | 0 | |
| 0 | 0 | 0 | 0 | 0 | 1 | 0 | 1 | 0 | 0 | 0 | 0 | |
| 0 | 0 | 0 | 0 | 0 | 1 | 1 | 0 | 0 | 0 | 0 | 0 | |
| 0 | 0 | 0 | 0 | 0 | 1 | 1 | 1 | 0 | 0 | 0 | 0 | |
| 0 | 0 | 0 | 0 | 1 | 0 | 0 | 0 | 0 | 0 | 0 | 0 | |
| 0 | 0 | 0 | 0 | 1 | 0 | 0 | 1 | 0 | 0 | 0 | 0 | |
| 0 | 0 | 0 | 0 | 1 | 0 | 1 | 0 | 0 | 0 | 0 | 0 | |
| 0 | 0 | 0 | 0 | 1 | 0 | 1 | 1 | 0 | 0 | 0 | 0 | |
| 0 | 0 | 0 | 0 | 1 | 1 | 0 | 0 | 0 | 0 | 0 | 0 | |
| 0 | 0 | 0 | 0 | 1 | 1 | 0 | 1 | 0 | 0 | 0 | 0 | |
| 0 | 0 | 0 | 0 | 1 | 1 | 1 | 0 | 0 | 0 | 0 | 0 | |
| 0 | 0 | 0 | 0 | 1 | 1 | 1 | 1 | 0 | 0 | 0 | 0 | |
| 0 | 0 | 0 | 1 | 0 | 0 | 0 | 0 | 0 | 0 | 0 | 0 | |
| 0 | 0 | 0 | 1 | 0 | 0 | 0 | 1 | 0 | 0 | 0 | 0 | |
| 0 | 0 | 0 | 1 | 0 | 0 | 1 | 0 | 0 | 0 | 0 | 0 | |
| 0 | 0 | 0 | 1 | 0 | 0 | 1 | 1 | 0 | 0 | 0 | 0 | |
| 0 | 0 | 0 | 1 | 0 | 1 | 0 | 0 | 0 | 0 | 0 | 0 | |
| 0 | 0 | 0 | 1 | 0 | 1 | 0 | 1 | 0 | 0 | 0 | 0 | |
| 0 | 0 | 0 | 1 | 0 | 1 | 1 | 0 | 0 | 0 | 0 | 0 | |
| 0 | 0 | 0 | 1 | 0 | 1 | 1 | 1 | 0 | 0 | 0 | 0 | |
| 0 | 0 | 0 | 1 | 1 | 0 | 0 | 0 | 0 | 0 | 0 | 0 | |
| 0 | 0 | 0 | 1 | 1 | 0 | 0 | 1 | 0 | 0 | 0 | 0 | |
| 0 | 0 | 0 | 1 | 1 | 0 | 1 | 0 | 0 | 0 | 0 | 0 | |
| 0 | 0 | 0 | 1 | 1 | 0 | 1 | 1 | 0 | 0 | 0 | 0 | |
| 0 | 0 | 0 | 1 | 1 | 1 | 0 | 0 | 0 | 0 | 0 | 0 | |
| 0 | 0 | 0 | 1 | 1 | 1 | 0 | 1 | 0 | 0 | 0 | 0 | |
| 0 | 0 | 0 | 1 | 1 | 1 | 1 | 0 | 0 | 0 | 0 | 0 | |
| 0 | 0 | 0 | 1 | 1 | 1 | 1 | 1 | 0 | 0 | 0 | 0 | |
| 0 | 0 | 1 | 0 | 0 | 0 | 0 | 0 | 0 | 0 | 0 | 0 | |
| 0 | 0 | 1 | 0 | 0 | 0 | 0 | 1 | 0 | 0 | 0 | 0 | |
| 0 | 0 | 1 | 0 | 0 | 0 | 1 | 0 | 0 | 0 | 0 | 0 | |
| 0 | 0 | 1 | 0 | 0 | 0 | 1 | 1 | 0 | 0 | 0 | 0 | |
| 0 | 0 | 1 | 0 | 0 | 1 | 0 | 0 | 0 | 0 | 0 | 0 | |
| 0 | 0 | 1 | 0 | 0 | 1 | 0 | 1 | 0 | 0 | 0 | 0 | |
| 0 | 0 | 1 | 0 | 0 | 1 | 1 | 0 | 0 | 0 | 0 | 0 | |
| 0 | 0 | 1 | 0 | 0 | 1 | 1 | 1 | 0 | 0 | 0 | 0 | |

-continued

| | | | | | | | | | | | | |
|---|---|---|---|---|---|---|---|---|---|---|---|---|
| 0 | 0 | 1 | 0 | 1 | 0 | 0 | 0 | 0 | 0 | 0 | 0 | |
| 0 | 0 | 1 | 0 | 1 | 0 | 0 | 1 | 0 | 0 | 0 | 0 | |
| 0 | 0 | 1 | 0 | 1 | 0 | 1 | 0 | 0 | 0 | 0 | 0 | |
| 0 | 0 | 1 | 0 | 1 | 0 | 1 | 1 | 0 | 0 | 0 | 0 | |
| 0 | 0 | 1 | 0 | 1 | 1 | 0 | 0 | 0 | 0 | 0 | 0 | |
| 0 | 0 | 1 | 0 | 1 | 1 | 0 | 1 | 0 | 0 | 0 | 0 | |
| 0 | 0 | 1 | 0 | 1 | 1 | 1 | 0 | 0 | 0 | 0 | 0 | |
| 0 | 0 | 1 | 0 | 1 | 1 | 1 | 1 | 0 | 0 | 0 | 0 | |
| 0 | 0 | 1 | 1 | 0 | 0 | 0 | 0 | 0 | 0 | 0 | 0 | |
| 0 | 0 | 1 | 1 | 0 | 0 | 0 | 1 | 0 | 0 | 0 | 0 | |
| 0 | 0 | 1 | 1 | 0 | 0 | 1 | 0 | 0 | 0 | 0 | 0 | |
| 0 | 0 | 1 | 1 | 0 | 0 | 1 | 1 | 0 | 0 | 0 | 0 | |
| 0 | 0 | 1 | 1 | 0 | 1 | 0 | 0 | 0 | 0 | 0 | 0 | |
| 0 | 0 | 1 | 1 | 0 | 1 | 0 | 1 | 0 | 0 | 0 | 0 | |
| 0 | 0 | 1 | 1 | 0 | 1 | 1 | 0 | 0 | 0 | 0 | 0 | |
| 0 | 0 | 1 | 1 | 0 | 1 | 1 | 1 | 0 | 0 | 1 | 1 | |
| 0 | 0 | 1 | 1 | 1 | 0 | 0 | 0 | 0 | 0 | 0 | 0 | |
| 0 | 0 | 1 | 1 | 1 | 0 | 0 | 1 | 0 | 0 | 0 | 0 | |
| 0 | 0 | 1 | 1 | 1 | 0 | 1 | 0 | 0 | 0 | 0 | 0 | |
| 0 | 0 | 1 | 1 | 1 | 0 | 1 | 1 | 0 | 0 | 0 | 0 | |
| 0 | 0 | 1 | 1 | 1 | 1 | 0 | 0 | 0 | 0 | 0 | 0 | |
| 0 | 0 | 1 | 1 | 1 | 1 | 0 | 1 | 0 | 0 | 0 | 0 | |
| 0 | 0 | 1 | 1 | 1 | 1 | 1 | 0 | 0 | 0 | 0 | 0 | |
| 0 | 0 | 1 | 1 | 1 | 1 | 1 | 1 | 0 | 0 | 1 | 1 | |
| 0 | 1 | 0 | 0 | 0 | 0 | 0 | 0 | 0 | 0 | 0 | 1 | Single Flash |
| 0 | 1 | 0 | 0 | 0 | 0 | 0 | 1 | 0 | 0 | 0 | 1 | |
| 0 | 1 | 0 | 0 | 0 | 0 | 1 | 0 | 0 | 0 | 0 | 1 | |
| 0 | 1 | 0 | 0 | 0 | 0 | 1 | 1 | 0 | 0 | 0 | 1 | |
| 0 | 1 | 0 | 0 | 0 | 1 | 0 | 0 | 0 | 0 | 0 | 0 | |
| 0 | 1 | 0 | 0 | 0 | 1 | 0 | 1 | 0 | 0 | 0 | 0 | |
| 0 | 1 | 0 | 0 | 0 | 1 | 1 | 0 | 0 | 0 | 0 | 0 | |
| 0 | 1 | 0 | 0 | 0 | 1 | 1 | 1 | 0 | 0 | 0 | 0 | |
| 0 | 1 | 0 | 0 | 1 | 0 | 0 | 0 | 0 | 0 | 0 | 0 | |
| 0 | 1 | 0 | 0 | 1 | 0 | 0 | 1 | 0 | 0 | 0 | 0 | |
| 0 | 1 | 0 | 0 | 1 | 0 | 1 | 0 | 0 | 0 | 0 | 0 | |
| 0 | 1 | 0 | 0 | 1 | 0 | 1 | 1 | 0 | 0 | 0 | 0 | |
| 0 | 1 | 0 | 0 | 1 | 1 | 0 | 0 | 0 | 0 | 0 | 0 | |
| 0 | 1 | 0 | 0 | 1 | 1 | 0 | 1 | 0 | 0 | 0 | 0 | |
| 0 | 1 | 0 | 0 | 1 | 1 | 1 | 0 | 0 | 0 | 0 | 0 | |
| 0 | 1 | 0 | 0 | 1 | 1 | 1 | 1 | 0 | 0 | 0 | 0 | |
| 0 | 1 | 0 | 1 | 0 | 0 | 0 | 0 | 0 | 0 | 0 | 0 | |
| 0 | 1 | 0 | 1 | 0 | 0 | 0 | 1 | 0 | 0 | 0 | 0 | |
| 0 | 1 | 0 | 1 | 0 | 0 | 1 | 0 | 0 | 0 | 0 | 0 | |
| 0 | 1 | 0 | 1 | 0 | 0 | 1 | 1 | 0 | 0 | 0 | 0 | |
| 0 | 1 | 0 | 1 | 0 | 1 | 0 | 0 | 0 | 0 | 0 | 0 | |
| 0 | 1 | 0 | 1 | 0 | 1 | 0 | 1 | 0 | 0 | 0 | 0 | |
| 0 | 1 | 0 | 1 | 0 | 1 | 1 | 0 | 0 | 0 | 0 | 0 | |
| 0 | 1 | 0 | 1 | 0 | 1 | 1 | 1 | 0 | 0 | 0 | 0 | |
| 0 | 1 | 0 | 1 | 1 | 0 | 0 | 0 | 0 | 0 | 0 | 0 | |
| 0 | 1 | 0 | 1 | 1 | 0 | 0 | 1 | 0 | 0 | 0 | 0 | |
| 0 | 1 | 0 | 1 | 1 | 0 | 1 | 0 | 0 | 0 | 0 | 0 | |
| 0 | 1 | 0 | 1 | 1 | 0 | 1 | 1 | 0 | 0 | 0 | 0 | |
| 0 | 1 | 0 | 1 | 1 | 1 | 0 | 0 | 0 | 0 | 0 | 0 | |
| 0 | 1 | 0 | 1 | 1 | 1 | 0 | 1 | 0 | 0 | 0 | 0 | |
| 0 | 1 | 0 | 1 | 1 | 1 | 1 | 0 | 0 | 0 | 0 | 0 | |
| 0 | 1 | 0 | 1 | 1 | 1 | 1 | 1 | 0 | 0 | 0 | 0 | |
| 0 | 1 | 1 | 0 | 0 | 0 | 0 | 0 | 0 | 0 | 0 | 0 | |
| 0 | 1 | 1 | 0 | 0 | 0 | 0 | 1 | 0 | 0 | 0 | 0 | |
| 0 | 1 | 1 | 0 | 0 | 0 | 1 | 0 | 0 | 0 | 0 | 0 | |
| 0 | 1 | 1 | 0 | 0 | 0 | 1 | 1 | 0 | 0 | 0 | 0 | |
| 0 | 1 | 1 | 0 | 0 | 1 | 0 | 0 | 0 | 0 | 0 | 0 | |
| 0 | 1 | 1 | 0 | 0 | 1 | 0 | 1 | 0 | 0 | 0 | 0 | |
| 0 | 1 | 1 | 0 | 0 | 1 | 1 | 0 | 0 | 0 | 0 | 0 | |
| 0 | 1 | 1 | 0 | 0 | 1 | 1 | 1 | 0 | 0 | 0 | 0 | |
| 0 | 1 | 1 | 0 | 1 | 0 | 0 | 0 | 0 | 0 | 0 | 0 | |
| 0 | 1 | 1 | 0 | 1 | 0 | 0 | 1 | 0 | 0 | 0 | 0 | |
| 0 | 1 | 1 | 0 | 1 | 0 | 1 | 0 | 0 | 0 | 0 | 0 | |
| 0 | 1 | 1 | 0 | 1 | 0 | 1 | 1 | 0 | 0 | 0 | 0 | |
| 0 | 1 | 1 | 0 | 1 | 1 | 0 | 0 | 0 | 0 | 0 | 0 | |
| 0 | 1 | 1 | 0 | 1 | 1 | 0 | 1 | 0 | 0 | 0 | 0 | |
| 0 | 1 | 1 | 0 | 1 | 1 | 1 | 0 | 0 | 0 | 0 | 0 | |
| 0 | 1 | 1 | 0 | 1 | 1 | 1 | 1 | 0 | 0 | 0 | 0 | |
| 0 | 1 | 1 | 1 | 0 | 0 | 0 | 0 | 0 | 0 | 0 | 0 | |
| 0 | 1 | 1 | 1 | 0 | 0 | 0 | 1 | 0 | 0 | 0 | 0 | |
| 0 | 1 | 1 | 1 | 0 | 0 | 1 | 0 | 0 | 0 | 0 | 0 | |
| 0 | 1 | 1 | 1 | 0 | 0 | 1 | 1 | 0 | 0 | 0 | 0 | |
| 0 | 1 | 1 | 1 | 0 | 1 | 0 | 0 | 0 | 0 | 0 | 0 | |
| 0 | 1 | 1 | 1 | 0 | 1 | 0 | 1 | 0 | 0 | 0 | 0 | |
| 0 | 1 | 1 | 1 | 0 | 1 | 1 | 0 | 0 | 0 | 0 | 0 | |
| 0 | 1 | 1 | 1 | 1 | 0 | 0 | 0 | 0 | 0 | 0 | 0 | |
| 0 | 1 | 1 | 1 | 1 | 0 | 0 | 1 | 0 | 0 | 0 | 0 | |

-continued

| | | | | | | | | | | | | |
|---|---|---|---|---|---|---|---|---|---|---|---|---|
| 0 | 1 | 1 | 1 | 1 | 0 | 1 | 0 | 0 | 0 | 0 | 0 | |
| 0 | 1 | 1 | 1 | 1 | 0 | 1 | 1 | 0 | 0 | 0 | 0 | |
| 0 | 1 | 1 | 1 | 1 | 1 | 0 | 0 | 0 | 0 | 0 | 0 | |
| 0 | 1 | 1 | 1 | 1 | 1 | 0 | 1 | 0 | 0 | 0 | 0 | |
| 0 | 1 | 1 | 1 | 1 | 1 | 1 | 0 | 0 | 0 | 0 | 0 | |
| 0 | 1 | 1 | 1 | 1 | 1 | 1 | 1 | 0 | 0 | 1 | 1 | |
| 1 | 0 | 0 | 0 | 0 | 0 | 0 | 0 | 0 | 0 | 0 | 1 | Triple Flash |
| 1 | 0 | 0 | 0 | 0 | 0 | 0 | 1 | 0 | 0 | 0 | 1 | |
| 1 | 0 | 0 | 0 | 0 | 0 | 1 | 0 | 0 | 0 | 0 | 1 | |
| 1 | 0 | 0 | 0 | 0 | 0 | 1 | 1 | 0 | 0 | 0 | 1 | |
| 1 | 0 | 0 | 0 | 0 | 1 | 0 | 0 | 0 | 0 | 0 | 0 | |
| 1 | 0 | 0 | 0 | 0 | 1 | 0 | 1 | 0 | 0 | 0 | 0 | |
| 1 | 0 | 0 | 0 | 0 | 1 | 1 | 0 | 0 | 0 | 0 | 0 | |
| 1 | 0 | 0 | 0 | 0 | 1 | 1 | 1 | 0 | 0 | 0 | 0 | |
| 1 | 0 | 0 | 0 | 1 | 0 | 0 | 0 | 0 | 0 | 0 | 0 | |
| 1 | 0 | 0 | 0 | 1 | 0 | 0 | 1 | 0 | 0 | 0 | 0 | |
| 1 | 0 | 0 | 0 | 1 | 0 | 1 | 0 | 0 | 0 | 0 | 0 | |
| 1 | 0 | 0 | 0 | 1 | 0 | 1 | 1 | 0 | 0 | 0 | 0 | |
| 1 | 0 | 0 | 0 | 1 | 1 | 0 | 0 | 0 | 0 | 0 | 0 | |
| 1 | 0 | 0 | 0 | 1 | 1 | 0 | 1 | 0 | 0 | 0 | 0 | |
| 1 | 0 | 0 | 0 | 1 | 1 | 1 | 0 | 0 | 0 | 0 | 0 | |
| 1 | 0 | 0 | 0 | 1 | 1 | 1 | 1 | 0 | 0 | 0 | 0 | |
| 1 | 0 | 0 | 1 | 0 | 0 | 0 | 0 | 0 | 0 | 0 | 0 | |
| 1 | 0 | 0 | 1 | 0 | 0 | 0 | 1 | 0 | 0 | 0 | 0 | |
| 1 | 0 | 0 | 1 | 0 | 0 | 1 | 0 | 0 | 0 | 0 | 0 | |
| 1 | 0 | 0 | 1 | 0 | 0 | 1 | 1 | 0 | 0 | 0 | 0 | |
| 1 | 0 | 0 | 1 | 0 | 1 | 0 | 0 | 0 | 0 | 0 | 0 | |
| 1 | 0 | 0 | 1 | 0 | 1 | 0 | 1 | 0 | 0 | 0 | 0 | |
| 1 | 0 | 0 | 1 | 0 | 1 | 1 | 0 | 0 | 0 | 0 | 0 | |
| 1 | 0 | 0 | 1 | 0 | 1 | 1 | 1 | 0 | 0 | 0 | 0 | |
| 1 | 0 | 0 | 1 | 1 | 0 | 0 | 0 | 0 | 0 | 0 | 0 | |
| 1 | 0 | 0 | 1 | 1 | 0 | 0 | 1 | 0 | 0 | 0 | 0 | |
| 1 | 0 | 0 | 1 | 1 | 0 | 1 | 0 | 0 | 0 | 0 | 0 | |
| 1 | 0 | 0 | 1 | 1 | 0 | 1 | 1 | 0 | 0 | 0 | 0 | |
| 1 | 0 | 0 | 1 | 1 | 1 | 0 | 0 | 0 | 0 | 0 | 0 | |
| 1 | 0 | 0 | 1 | 1 | 1 | 0 | 1 | 0 | 0 | 0 | 0 | |
| 1 | 0 | 0 | 1 | 1 | 1 | 1 | 0 | 0 | 0 | 0 | 0 | |
| 1 | 0 | 0 | 1 | 1 | 1 | 1 | 1 | 0 | 0 | 0 | 0 | |
| 1 | 0 | 1 | 0 | 0 | 0 | 0 | 0 | 0 | 0 | 0 | 0 | |
| 1 | 0 | 1 | 0 | 0 | 0 | 0 | 1 | 0 | 0 | 0 | 0 | |
| 1 | 0 | 1 | 0 | 0 | 0 | 1 | 0 | 0 | 0 | 0 | 0 | |
| 1 | 0 | 1 | 0 | 0 | 0 | 1 | 1 | 0 | 0 | 0 | 0 | |
| 1 | 0 | 1 | 0 | 0 | 1 | 0 | 0 | 0 | 0 | 0 | 0 | |
| 1 | 0 | 1 | 0 | 0 | 1 | 0 | 1 | 0 | 0 | 0 | 0 | |
| 1 | 0 | 1 | 0 | 0 | 1 | 1 | 0 | 0 | 0 | 0 | 0 | |
| 1 | 0 | 1 | 0 | 0 | 1 | 1 | 1 | 0 | 0 | 0 | 0 | |
| 1 | 0 | 1 | 0 | 1 | 0 | 0 | 0 | 0 | 0 | 0 | 0 | |
| 1 | 0 | 1 | 0 | 1 | 0 | 0 | 1 | 0 | 0 | 1 | 1 | |
| 1 | 0 | 1 | 0 | 1 | 0 | 1 | 0 | 0 | 0 | 0 | 0 | |
| 1 | 0 | 1 | 0 | 1 | 0 | 1 | 1 | 0 | 0 | 0 | 0 | |
| 1 | 0 | 1 | 0 | 1 | 1 | 0 | 0 | 0 | 0 | 0 | 0 | |
| 1 | 0 | 1 | 0 | 1 | 1 | 0 | 1 | 0 | 0 | 0 | 0 | |
| 1 | 0 | 1 | 0 | 1 | 1 | 1 | 0 | 0 | 0 | 0 | 0 | |
| 1 | 0 | 1 | 0 | 1 | 1 | 1 | 1 | 0 | 0 | 0 | 1 | |
| 1 | 0 | 1 | 1 | 0 | 0 | 0 | 0 | 0 | 0 | 0 | 1 | |
| 1 | 0 | 1 | 1 | 0 | 0 | 0 | 1 | 0 | 0 | 0 | 1 | |
| 1 | 0 | 1 | 1 | 0 | 0 | 1 | 0 | 0 | 0 | 0 | 1 | |
| 1 | 0 | 1 | 1 | 0 | 0 | 1 | 1 | 0 | 0 | 0 | 1 | |
| 1 | 0 | 1 | 1 | 0 | 1 | 0 | 0 | 0 | 0 | 1 | 1 | |
| 1 | 0 | 1 | 1 | 0 | 1 | 0 | 1 | 0 | 0 | 0 | 0 | |
| 1 | 0 | 1 | 1 | 0 | 1 | 1 | 0 | 0 | 0 | 0 | 0 | |
| 1 | 0 | 1 | 1 | 0 | 1 | 1 | 1 | 0 | 0 | 0 | 0 | |
| 1 | 0 | 1 | 1 | 1 | 0 | 0 | 0 | 0 | 0 | 0 | 0 | |
| 1 | 0 | 1 | 1 | 1 | 0 | 0 | 1 | 0 | 0 | 0 | 0 | |
| 1 | 0 | 1 | 1 | 1 | 0 | 1 | 0 | 0 | 0 | 0 | 1 | |
| 1 | 0 | 1 | 1 | 1 | 0 | 1 | 1 | 0 | 0 | 0 | 1 | |
| 1 | 0 | 1 | 1 | 1 | 1 | 0 | 0 | 0 | 0 | 0 | 1 | |
| 1 | 0 | 1 | 1 | 1 | 1 | 0 | 1 | 0 | 0 | 0 | 1 | |
| 1 | 0 | 1 | 1 | 1 | 1 | 1 | 0 | 0 | 0 | 0 | 1 | |
| 1 | 0 | 1 | 1 | 1 | 1 | 1 | 1 | 0 | 0 | 1 | 1 | |
| 1 | 1 | 0 | 0 | 0 | 0 | 0 | 0 | 0 | 0 | 0 | 1 | Double Flash |
| 1 | 1 | 0 | 0 | 0 | 0 | 0 | 1 | 0 | 0 | 0 | 1 | |
| 1 | 1 | 0 | 0 | 0 | 0 | 1 | 0 | 0 | 0 | 0 | 1 | |
| 1 | 1 | 0 | 0 | 0 | 0 | 1 | 1 | 0 | 0 | 0 | 1 | |
| 1 | 1 | 0 | 0 | 0 | 1 | 0 | 0 | 0 | 0 | 0 | 0 | |
| 1 | 1 | 0 | 0 | 0 | 1 | 0 | 1 | 0 | 0 | 0 | 0 | |
| 1 | 1 | 0 | 0 | 0 | 1 | 1 | 0 | 0 | 0 | 0 | 0 | |
| 1 | 1 | 0 | 0 | 0 | 1 | 1 | 1 | 0 | 0 | 0 | 0 | |
| 1 | 1 | 0 | 0 | 1 | 0 | 0 | 0 | 0 | 0 | 0 | 0 | |
| 1 | 1 | 0 | 0 | 1 | 0 | 0 | 1 | 0 | 0 | 0 | 0 | |
| 1 | 1 | 0 | 0 | 1 | 0 | 1 | 0 | 0 | 0 | 0 | 0 | |
| 1 | 1 | 0 | 0 | 1 | 0 | 1 | 1 | 0 | 0 | 0 | 0 | |

-continued

| | | | | | | | | | | | |
|---|---|---|---|---|---|---|---|---|---|---|---|
| 1 | 1 | 0 | 0 | 1 | 1 | 0 | 0 | 0 | 0 | 0 | 0 |
| 1 | 1 | 0 | 0 | 1 | 1 | 0 | 1 | 0 | 0 | 0 | 0 |
| 1 | 1 | 0 | 0 | 1 | 1 | 1 | 0 | 0 | 0 | 0 | 0 |
| 1 | 1 | 0 | 0 | 1 | 1 | 1 | 1 | 0 | 0 | 0 | 0 |
| 1 | 1 | 0 | 1 | 0 | 0 | 0 | 0 | 0 | 0 | 0 | 0 |
| 1 | 1 | 0 | 1 | 0 | 0 | 0 | 1 | 0 | 0 | 0 | 0 |
| 1 | 1 | 0 | 1 | 0 | 0 | 1 | 0 | 0 | 0 | 0 | 0 |
| 1 | 1 | 0 | 1 | 0 | 0 | 1 | 1 | 0 | 0 | 0 | 0 |
| 1 | 1 | 0 | 1 | 0 | 1 | 0 | 0 | 0 | 0 | 0 | 0 |
| 1 | 1 | 0 | 1 | 0 | 1 | 0 | 1 | 0 | 0 | 0 | 0 |
| 1 | 1 | 0 | 1 | 0 | 1 | 1 | 0 | 0 | 0 | 0 | 0 |
| 1 | 1 | 0 | 1 | 0 | 1 | 1 | 1 | 0 | 0 | 0 | 0 |
| 1 | 1 | 0 | 1 | 1 | 0 | 0 | 0 | 0 | 0 | 0 | 0 |
| 1 | 1 | 0 | 1 | 1 | 0 | 0 | 1 | 0 | 0 | 0 | 0 |
| 1 | 1 | 0 | 1 | 1 | 0 | 1 | 0 | 0 | 0 | 0 | 0 |
| 1 | 1 | 0 | 1 | 1 | 0 | 1 | 1 | 0 | 0 | 0 | 0 |
| 1 | 1 | 0 | 1 | 1 | 1 | 0 | 0 | 0 | 0 | 0 | 0 |
| 1 | 1 | 0 | 1 | 1 | 1 | 0 | 1 | 0 | 0 | 0 | 0 |
| 1 | 1 | 0 | 1 | 1 | 1 | 1 | 0 | 0 | 0 | 0 | 0 |
| 1 | 1 | 0 | 1 | 1 | 1 | 1 | 1 | 0 | 0 | 0 | 0 |
| 1 | 1 | 1 | 0 | 0 | 0 | 0 | 0 | 0 | 0 | 0 | 0 |
| 1 | 1 | 1 | 0 | 0 | 0 | 0 | 1 | 0 | 0 | 0 | 0 |
| 1 | 1 | 1 | 0 | 0 | 0 | 1 | 0 | 0 | 0 | 0 | 0 |
| 1 | 1 | 1 | 0 | 0 | 0 | 1 | 1 | 0 | 0 | 0 | 0 |
| 1 | 1 | 1 | 0 | 0 | 1 | 0 | 0 | 0 | 0 | 0 | 0 |
| 1 | 1 | 1 | 0 | 0 | 1 | 0 | 1 | 0 | 0 | 0 | 0 |
| 1 | 1 | 1 | 0 | 0 | 1 | 1 | 0 | 0 | 0 | 0 | 0 |
| 1 | 1 | 1 | 0 | 0 | 1 | 1 | 1 | 0 | 0 | 0 | 0 |
| 1 | 1 | 1 | 0 | 1 | 0 | 0 | 0 | 0 | 0 | 0 | 0 |
| 1 | 1 | 1 | 0 | 1 | 0 | 0 | 1 | 0 | 0 | 0 | 0 |
| 1 | 1 | 1 | 0 | 1 | 0 | 1 | 0 | 0 | 0 | 0 | 0 |
| 1 | 1 | 1 | 0 | 1 | 0 | 1 | 1 | 0 | 0 | 0 | 0 |
| 1 | 1 | 1 | 0 | 1 | 1 | 0 | 0 | 0 | 0 | 0 | 0 |
| 1 | 1 | 1 | 0 | 1 | 1 | 0 | 1 | 0 | 0 | 0 | 0 |
| 1 | 1 | 1 | 0 | 1 | 1 | 1 | 0 | 0 | 0 | 0 | 0 |
| 1 | 1 | 1 | 0 | 1 | 1 | 1 | 1 | 0 | 0 | 0 | 0 |
| 1 | 1 | 1 | 1 | 0 | 0 | 0 | 0 | 0 | 0 | 0 | 0 |
| 1 | 1 | 1 | 1 | 0 | 0 | 0 | 1 | 0 | 0 | 0 | 0 |
| 1 | 1 | 1 | 1 | 0 | 0 | 1 | 0 | 0 | 0 | 0 | 0 |
| 1 | 1 | 1 | 1 | 0 | 0 | 1 | 1 | 0 | 0 | 0 | 0 |
| 1 | 1 | 1 | 1 | 0 | 1 | 0 | 0 | 0 | 0 | 0 | 0 |
| 1 | 1 | 1 | 1 | 0 | 1 | 0 | 1 | 0 | 0 | 0 | 0 |
| 1 | 1 | 1 | 1 | 0 | 1 | 1 | 0 | 0 | 0 | 0 | 0 |
| 1 | 1 | 1 | 1 | 0 | 1 | 1 | 1 | 0 | 0 | 0 | 0 |
| 1 | 1 | 1 | 1 | 1 | 0 | 0 | 0 | 0 | 0 | 0 | 0 |
| 1 | 1 | 1 | 1 | 1 | 0 | 0 | 1 | 0 | 0 | 0 | 0 |
| 1 | 1 | 1 | 1 | 1 | 0 | 1 | 0 | 0 | 0 | 0 | 0 |
| 1 | 1 | 1 | 1 | 1 | 0 | 1 | 1 | 0 | 0 | 0 | 0 |
| 1 | 1 | 1 | 1 | 1 | 1 | 0 | 0 | 0 | 0 | 0 | 0 |
| 1 | 1 | 1 | 1 | 1 | 1 | 0 | 1 | 0 | 0 | 0 | 0 |
| 1 | 1 | 1 | 1 | 1 | 1 | 1 | 0 | 0 | 0 | 0 | 0 |
| 1 | 1 | 1 | 1 | 1 | 1 | 1 | 1 | 0 | 0 | 1 | 1 |

What is claimed is:

1. A control circuit for discharging a strobe tube comprising:

means for supplying power to the strobe tube;

means, including a semiconductor memory and not including a microprocessor, for storing a preset pattern;

means for generating a sequential output provided to the memory, the memory being responsive to the sequential output to produce a pattern signal corresponding to the preset pattern; and means responsive to the pattern signal for triggering the strobe tube in accordance with the preset pattern.

2. The circuit of claim 1 for use in combination with a source of electricity and wherein the power supply means comprises a charging system including:

a transformer comprising:

a primary side connected to the source of electricity; and a secondary side connected to the strobe tube;

means for storing a charge connected in parallel with the strobe tube; and means for switching the primary side so that the secondary side charges the storing means.

3. The circuit of claim 1 further comprising means responsive to the memory for controlling the intensity of flashes of the strobe tube and wherein the preset pattern defines a flash cycle having a plurality of separate flashes, at least two of the flashes within the cycle having different intensities.

4. The circuit of claim 3 wherein the switching means further comprises:

a transistor connected in series with the primary side of the transformer; and a switching oscillator having an output port connected to the gate of the transistor for switching the transistor, wherein the transistor intermittently conducts a current.

5. The circuit of claim 4 wherein the memory defines a minimum period of time and further comprising means for disconnecting the power supply means from the strobe tube for the minimum period of time after the strobe tube is discharged, wherein the minimum period is greater than a period of time during which the connection of any electrical power to the strobe tube would result in current flowing through the strobe tube, whereby neoning of the strobe tube is prevented and the recharging period of the strobe tube is controlled to control the flash intensity of the strobe tube.

6. The circuit of claim 5 further comprising means for producing an anti-neoning pulse coincident with or after the discharge of the strobe tube, wherein the disconnecting means is responsive to the anti-neoning pulse.

7. The circuit of claim 6 wherein the sequential generating means comprises an oscillator for producing a series of counting pulses at a preset frequency and a binary counter responsive to the counting pulses for producing a sequential binary output; and wherein the semiconductor memory comprises a PROM responsive to the sequential binary output for producing the anti-neoning pulse.

8. The circuit of claim 6 wherein the means for electrically disconnecting the strobe tube further comprises means responsive to the anti-neoning pulse for inhibiting the transistor to prevent a current flow through the primary side of the transformer for a preset period greater than the minimum period whereby the amount of charge stored in the charge storing means between flashes is controlled to control the intensity of the strobe tube.

9. The circuit of claim 4 wherein the power supply means further comprises means for limiting a primary current flowing through the primary side of the transformer comprising:

a mirror terminal as an intergral part of the transistor for producing a mirror signal representative of the primary current; and means responsive to the mirror signal for switching the transistor to prevent primary current flow when the primary current exceeds a preset value;

whereby the current limiting means protests the power supply means from excess current flows during normal operation of in the event of a malfunction.

10. The circuit of claim 9 wherein the mirror terminal conducts less than 1% of the primary current whereby the primary current limiting means is virtually lossless.

11. The circuit of claim 10 wherein the power supply means further comprises:

means responsive to ambient light for producing an ambient light signal representative of a level of the ambient light; and means responsive to the ambient light signal for storing an amount of charge in the charge storing means as a function of the level of the ambient light.

12. The circuit of claim 1 wherein:

the power supply means comprises means for charging the strobe tube;

the pattern storing means comprises means for generating a series of timing pulses; and the triggering means is responsive to the series of timing pulses for discharging the strobe tube.

13. The circuit of claim 12 wherein the semiconductor memory comprises a plurality of partitioned memory segments, each for storing a separate preset pattern, each said pattern for producing a series of timing pulses.

14. The circuit of claim 1 wherein the generating means further comprises an oscillator for producing a series of counting pulses at a preset frequency and a binary counter responsive to the counting pulses for producing a sequential binary output; wherein the memory comprises a PROM responsive to the sequential binary output for producing a series of timing pulses.

15. The circuit of claim 1 wherein the power supply means further comprises:

means, connected in parallel with the strobe tube for storing an electrical charge;

means responsive to ambient light for producing an ambient light signal representative of a level of the ambient light; and means responsive to the ambient light signal for storing a preset amount of charge in the charge storing means as a function of the level of the ambient light.

16. The circuit of claim 15 wherein a first preset amount of charge is stored in the charge storing means when the level of ambient light is below a threshold level and wherein a second preset amount of charge is stored in the charge storing means when the level of ambient light is above the threshold level.

17. The circuit of claim 1 further comprising means responsive to the pattern storing means for controlling the intensity of the flashes of the strobe tube and wherein the preset pattern of the pattern storing means defines at least two separate flashes within the preset pattern having different intensities.

18. An anti-neoning control circuit comprising:

strobe means which is repeatedly charged and discharged;

a power supply for charging the strobe means;

means for producing a sequential output;

a semiconductor read only memory responsive to the sequential output for producing a anti-neoning pulse of a predetermined duration;

means responsive to the anti-neoning pulse for disconnecting the strobe means from the power supply after the discharge for the predetermined duration, wherein the predetermined duration is greater than a period of time after the discharge during which the connection of the power supply to the strobe tube would result in current flowing through the strobe tube whereby neoning of the strobe tube is prevented and wherein the predetermined duration controls the charging time of the strobe means whereby the flash intensity of the strobe means is a function of the anti-neoning pulse.

19. The circuit of claim 18 wherein the means for producing a sequential output further comprises:
an oscillator for producing a series of counting pulses at a preset frequency; and
a binary counter responsive to the counting pulses for producing a sequential binary output.

20. A flashing circuit for providing repeated high-intensity flashes comprising:
a strobe tube;
means for supplying power to the strobe tube;
means, including a semiconductor memory and not including a microprocessor, for storing a preset pattern;
means for providing a sequential output to the memory, the memory being responsive to the sequential output to produce a pattern signal corresponding to the preset pattern; and
means responsive to the pattern signal for triggering the strobe tube in accordance with the preset pattern.

21. The circuit of claim 20 for use in combination with a source of electricity and wherein the power supply means comprises a charging system including:
a transformer comprising:
a primary side connected to the source of electricity; and
a secondary side connected to the strobe tube;
means for storing a charge connected in parallel with the strobe tube; and
means for switching the primary side so that the secondary side charges the storing means.

22. The circuit of claim 21 wherein the switching means further comprises:
a transistor connected in series with the primary side of the transformer; and
a switching oscillator having an output port connected to the gate of the transistor for switching the transistor, wherein the transistor intermittently conducts a current.

23. The circuit of claim 22 wherein the power supply means further comprises means for limiting a primary current flowing through the primary side of the transformer comprising:
a mirror terminal as an integral part of the transistor for producing a mirror signal representative of the primary current; and
means responsive to the mirror signal for switching the transistor to prevent primary current flow when the primary current exceeds a preset value;
whereby the current limiting means protests the power supply means from excess current flows during normal operation or in the event of a malfunction.

24. The circuit of claim 23 wherein the memory defines a minimum period of time and further comprising means for disconnecting the power supply means from the strobe tube for the minimum period of time after the strobe tube is discharged, wherein the minimum period is greater than a period of time during which the connection of any electrical power to the strobe tube would result in current flowing through the strobe tube, whereby neoning of the strobe tube is prevented and the recharging period of the strobe tube is controlled to control the flash intensity of the strobe tube.

25. The circuit of claim 24 wherein the power supply means further comprises:
means responsive to ambient light for producing an ambient light signal representative of a level of the ambient light; and
means responsive to the ambient light signal for storing a preset amount of charge in the charge storing means as a function of the level of the ambient light.

26. The circuit of claim 23 wherein the power supply means further comprises:
means responsive to ambient light for producing an ambient light signal representative of a level of the ambient light; and
means responsive to the ambient light signal for storing a preset amount of charge in the charge storing means as a function of the level of the ambient light.

27. The circuit of claim 20 wherein the memory defines a minimum period of time and further comprising means for disconnecting the power supply means from the strobe tube for the minimum period of time after the strobe tube is discharged, wherein the minimum period is greater than a period of time during which the connection of any electrical power to the strobe tube would result in current flowing through the strobe tube, whereby neoning of the strobe tube is prevented and the recharging period of the strobe tube is controlled to control the flash intensity of the strobe tube.

28. The circuit of claim 27 wherein the power supply means further comprises:
means, connected in parallel with the strobe tube for storing an electrical charge;
means responsive to ambient light for producing an ambient light signal representative of a level of the ambient light; and
means responsive to the ambient light signal for storing a preset amount of charge in the charge storing means as a function of the level of the ambient light.

29. The circuit of claim 20 wherein the power supply means further comprises:
means, connected in parallel with the strobe tube for storing an electrical charge;
means responsive to ambient light for producing an ambient light signal representative of a level of the ambient light; and
means responsive to the ambient light signal for storing a preset amount of charge in the charge storing means as a function of the level of the ambient light.

30. A control circuit for discharging a strobe tube in accordance with operator input comprising:
means for supplying power to the strobe tube;
a first circuit generating one flash per cycle and a second circuit generating two flashes per cycle;
a first selectable connection for activating the first circuit and disabling the second circuit and a second selectable connection for activating the second circuit and disabling the first circuit; and
means responsive to the pattern indicating means for triggering the strobe tube n accordance with the indicated flash pattern as specified by the first or second selectable connection.

31. The circuit of claim 30 wherein the pattern indicating means further comprises a third circuit generating three flashes per cycle and wherein the selecting means selects the first, second or third circuit in response to operator input.

32. The circuit of claim 31 further comprising a first selectable connection for activating the first circuit and disabling the second and third circuits, a second selectable connection for activating the second circuit and disabling the first and third circuits, and a third selectable connection for activating the third circuit and disabling the first and second circuits.

33. The circuit of claim 30 wherein the selecting means comprises jumpers for selectively, alternatively enabling the first or second circuits.

34. The circuit of claim 33 having first and second jumpers and means for restoring the pattern to the same flash pattern, as when both the first and second jumpers are in place, when the first and second jumpers are removed whereby the circuit provides a first flash pattern if the first jumper is removed, a second flash pattern if the second jumper is removed, and a third flash pattern if both the first and second jumpers are in place or if both the first and second jumpers are removed.

35. The circuit of claim 30 further comprising means responsive to the second circuit for controlling the intensity of the flashes of the strobe tube and wherein the two flashes per cycle comprises two separate flashes having different intensities.

36. The circuit of claim 20 further comprising means responsive to the memory for controlling the intensity of flashes of the strobe tube and wherein the preset pattern defines a flash cycle having a plurality of separate flashes, at least two of the flashes within the cycle having different intensities.

37. A flashing circuit for providing repeated high intensity flashes comprising:

a strobe tube;

means for storing a charge connected to the strobe tube;

means for supplying power to the strobe tube and to the charge storing means;

means for defining a preset period between flashes during which the power supply means supplies power to the strobe tube and the charge storing means;

means for generating an anti-neoning pulse; and means, responsive to the anti-neoning pulse, for inhibiting the power supply means during the anti-neoning pulse so that the charge stored in the charge storing means is a function of the duration of the anti-neoning pulse whereby neoning of the strobe tube is prevented by the anti-neoning pulse and the flash intensity of the strobe tube is controlled by the anti-neoning pulse duration.

38. A flashing circuit for providing repeated high intensity flashes comprising:

a strobe tube;

means for supplying power to the strobe tube including a transformer having a primary side connected to a source of electricity and a secondary side connected to the strobe tube, means for storing a charge connected in parallel with the strobe tube, a transistor connected in series with the primary side of the transformer, means for switching the transistor to intermittently conduct a current, a mirror terminal as an integral part of the transistor for producing a mirror signal representative of the primary current and means responsive to the mirror signal for switching the transistor to prevent primary current flow when the primary current exceeds a preset value;

means for defining a preset pattern; and means responsive to the pattern defining means for triggering the strobe tube whereby the strobe tube flashes in accordance with the preset pattern.

* * * * *